US005432325A

United States Patent [19]

Katz et al.

[11] Patent Number: 5,432,325

[45] Date of Patent: Jul. 11, 1995

[54] MICROWAVE SINTERING OF SINGLE PLATE-SHAPED ARTICLES

[75] Inventors: Joel D. Katz, Los Alamos, N. Mex.; Rodger D. Blake, Tucson, Ariz.

[73] Assignee: University of California, Alameda, Calif.

[21] Appl. No.: 326,680

[22] Filed: Oct. 20, 1994

[51] Int. Cl.[6] ..... H05B 6/80

[52] U.S. Cl. ..... 219/759; 219/762; 264/25

[58] Field of Search ..... 219/759, 762, 730, 732, 219/734; 264/25, 26, 27

[56] References Cited

U.S. PATENT DOCUMENTS

| | | | |
|---|---|---|---|
| 3,900,542 | 8/1975 | Palmour et al. | 264/40 |
| 4,307,277 | 12/1981 | Maeda et al. | 219/10.55 R |
| 4,505,787 | 3/1985 | Fuller et al. | 204/67 |
| 4,617,439 | 10/1986 | Lespinats et al. | 219/759 |
| 4,748,308 | 5/1988 | Drews | 219/759 |
| 4,822,966 | 4/1989 | Matsubara | 219/759 |
| 4,963,709 | 10/1990 | Kimrey, Jr. | 219/10.55 M |
| 5,072,087 | 12/1991 | Apte et al. | 219/759 |
| 5,164,130 | 11/1992 | Holcombe et al. | 264/26 |
| 5,191,183 | 3/1993 | Balbaa et al. | 219/10.55 M |
| 5,202,541 | 4/1993 | Patterson et al. | 219/759 |
| 5,227,600 | 7/1993 | Blake et al. | 219/10.55 M |

OTHER PUBLICATIONS

"Microwave Sintering of Large Alumina Bodies", Microwaves: Theory and Application In Materials *Processing II, Ceramic Transactions* 36, (1993).

"The Properties of Alumina Sintered in a 2.45 Ghz Microwave Field," Mat. Res. Soc. Symp. Proc. vol. 189 (1991), Mark C. L. Patterson et al.

"Microwave Sintering of $Al_2O_3$ and $Al_2O_3$-SiC Whisker Composites," Ceram. Eng. Sci. Proc., 8 (7-8), pp. 861-871 (1987), T. T. Meek et al.

"Microwave Sintering Alumina Spark Plug Insulators," Amer. Ceramic Soc., Electronics Division Fall Meeting Sep. 11-14, 1983, Normal W. Schubring.

"Microwave Sintering of Multiple Alumina and Composite Components," Ceramic Bulletin, vol. 70, No. 8 (1991), Joel D. Katz et al.

*Primary Examiner*—Philip H. Leung

*Attorney, Agent, or Firm*—Richard J. Cordovano

[57] ABSTRACT

Apparatus and method for high temperature sintering of plate-shaped articles of alumina, magnesia, silica, yttria, zirconia, and mixtures thereof using microwave radiation. An article is placed within a sintering structure located within a sintering container which is placed in a microwave cavity for heating. The rates at which heating and cooling take place is controlled.

6 Claims, 1 Drawing Sheet

MICROWAVE SINTERING OF SINGLE PLATE-SHAPED ARTICLES

This invention was made with government support under Contract No. W-7405-ENG-36 awarded by the U.S. Department of Energy. The government has certain rights in the invention.

BACKGROUND OF THE INVENTION

This invention relates to materials science and, more particularly, to processing of materials using microwave radiation for heating the materials. It currently requires many hours to produce densified articles of alumina and other refractory materials using conventional heat sources. Articles of relatively small size have been sintered using microwave radiation, but sintering of large articles had not been successfully demonstrated. A multi-mode microwave cavity contains an inherently non-uniform electromagnetic field, but smaller bodies are not significantly affected by microwave field non-uniformity. Prior to the present invention, it has not been possible to densify by microwave sintering large articles of these materials having the form of plates or disks, as articles warped, cracked, and shattered, due to the non-uniform field. Hot spots were caused by the areas of concentrated microwave energy.

SUMMARY OF THE INVENTION

This invention is apparatus and method for high temperature sintering of plate-shaped articles of alumina, magnesia, silica, yttria, zirconia, and mixtures thereof using microwave radiation article is placed within a sintering structure located within a sintering container which is placed in a microwave cavity for heating. The rates at which heating and cooling take place is controlled.

DETAILED DESCRIPTION OF THE INVENTION

This invention is described in a paper entitled "Microwave Sintering of Large Alumina Bodies" by Katz and Blake which appeared in Ceramic Transactions, Microwaves: Theory and Application in Materials Processing II, Vol. 36, published by The American Ceramic Society (October 1993). This paper is hereby incorporated in full into this patent application.

Figure 1:
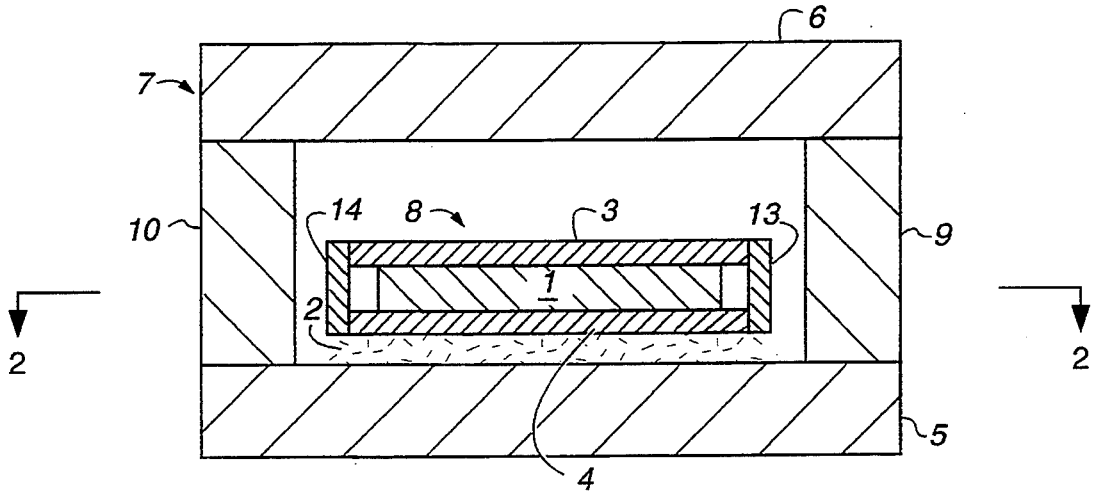
FIG. 1 depicts a microwave sintering container and susceptor structure for use in sintering articles in sectional side view.
Figure 2:
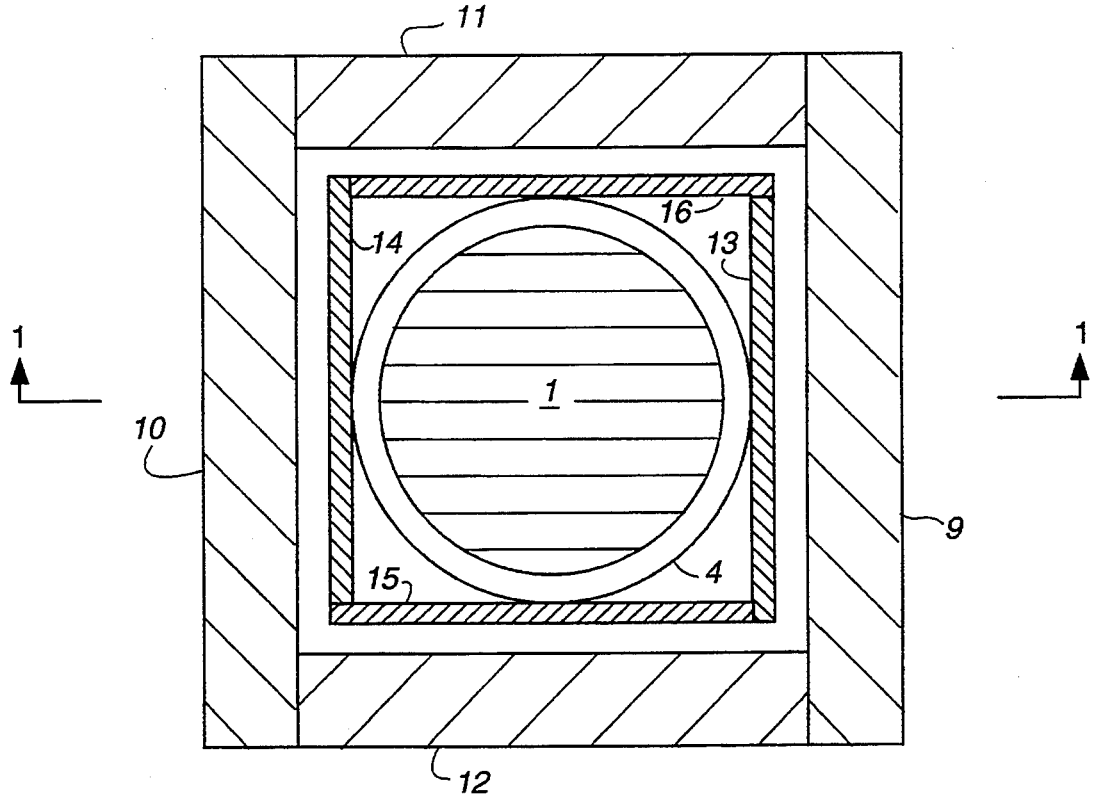
FIG. 2 is a sectional plan view of the apparatus of FIG. 1.

FIGS. 1 and 2 depict apparatus which was used in experimentation in sintering articles and they are used herein in describing an exemplary embodiment of the invention. The drawings are not to scale. Both are section views which are taken as shown by the section arrows on each drawing. Article 1 is surrounded by susceptor structure 8, which is located within sintering container 7. A layer of alumina particles 2 separates susceptor structure from sintering container 7. Susceptor structure consists of base susceptor 4, upper susceptor 3, and susceptor side panels 13, 14, 3, and 16. Article 1 rests upon base susceptor and upper susceptor rests upon article 1. In this experimentation, the side panels were not attached to the upper susceptor or base susceptor, but simply set in place.

The dimensions of article before it was sintered were 6.1875 inches in diameter by 0.75 inch thick. It weighed 925 grams. Base susceptor 4 is a carbon disk 6.625 inches in diameter by 0.125 inch thick. Upper susceptor 3 is the same diameter as base susceptor 3 and 0.25 inch thick. For convenience, two 0.125 inch thick carbon disks are used to form the upper susceptor. Each susceptor side panel consists of two carbon strips, each 6.75 inches by 1.25 inches by 0.125 inch thick, so the total thickness of a side panel is 0.25 inch. For drawing convenience, FIGS. 1 and 2 depict each side panel as if it were a single piece; the slight difference in dimension introduced by using the two strips for a side panel is not at all significant.

Sintering container 7 consists of base 5, top cover 6, and sidewalls 9, 10, 11, and 12 and each of these components is 1.5 inches thick. The plan dimensions of the base are 11 inches by 11 inches and the size of the top cover is the same as the base. The height of each sidewall is 3.5 inches, so that the clear height of the inside of the sintering container when it is empty is 3.5 inches and the total height of the sintering container is 6.5 inches.

The sintering container with the article and sintering structure inside was heated in a microwave cavity using microwave radiation having a frequency of 2.45 Ghz. Microwave power was provided to the cavity from a 6 kilowatt variable power microwave generator via a waveguide. A slug tuner mounted in the cavity was used to reduce reflected microwave power and to enhance microwave coupling to the sintering structure and article. The container was placed on a table which could be raised or lowered within the cavity. The article was made by unaxial cold pressing of alumina powder (99.99% purity, 0.2 micron mean particle size) obtained from Sumitomo Chemical Company of Osaka, Japan (grade AKP-50) at about 170 psi. The density of the article before sintering was about 55% of theoretical density. The article was heated to a temperature of about 1600° C. and held at that temperature for about 10 minutes. The rate of heating was maintained at a value less than about 48° C. per minute, as other experimentation had shown that heating at a greater rate caused cracking of articles. It is expected that the hold temperature may be varied within a range of from about 1400° to about 1700° C. and the time for which the temperature is maintained within the hold temperature range may be from about 5 to about 60 minutes. The microwave power level was reduced to maintain the article at the hold temperature. Temperature was measured by means of an optical fiber thermometer inserted through small horizontal channels drilled through sidewall 10 and susceptor side panel 14 (not shown on the drawings), so that the temperature of the surface of the article is measured. The temperature measuring equipment does not measure temperatures below about 500° C.; however, it is believed that 0 the rate of heating below 500° C. is less than 48° C. per minute. After the hold period, temperature was slowly lowered to about 1300° C. by reducing the microwave power, at which point the power was turned off and the articles allowed to cool at a rate determined by the physical surroundings. It is believed that the maximum cooling rate should be no more than about 30° C. per minute in order to avoid cracking of the articles. It should be noted that the rate of cooling is established in part by the design of the sintering container, as the insulation material slows the rate of cooling. The total processing cycle required about 7.5 hours. Theoretical density of the sintered alumina article was about 93% of theoretical density and the assintered dimensions were about 0.1875 inches diameter and about 0.625 inch high. The microstructure of the sintered alumina article was quite uniform, having only isolated porosity, and grain size did not vary with location in an article. The grain size was about 5 to 50 microns.

The insulating material used in the experimentation was Type SALI alumina insulation from Zircar Products, Inc. of Florida, NY, which the manufacturer specifies as having a composition of about 80wt % of $Al_2O_3$ and about 20wt % $SiO_2$ and a density of about 0.48 gram per cubic centimeter. Other materials which are suitable for high temperature use and have sufficiently low thermal conductivity to provide an insulating function may be used; examples of such materials are magnesium oxide, boron nitride, and yttrium oxide. Another requirement for an insulating material is that it be relatively transparent to microwaves, so that it does not heat to any significant degree when subjected to microwave radiation. Alumina increasingly suscepts microwaves as its temperature increases, with significant heating starting at about 1000° C. However, the high porosity of the alumina insulation used results in its functioning primarily as an insulator. The alumina particles used on the base of the sintering container are known as 60 mesh alumina grain. It is not required that a layer of particles be used, but such use may prevent the container base from sticking to the base susceptor and prevent contamination of the sintered articles. Similarly, particles may also be used between the article and upper susceptor.

The susceptor material used in the experimentation was Carbocell, Grade 60, which is sold by Sigri Great Lakes Carbon Corp. of Morganton, NC. The carbon oxidized to a degree that precluded its re-use; this was due to traces of oxygen in the microwave cavity which was used, even though argon was flowed through the cavity. A tighter cavity filled with an inert gas will preserve carbon susceptors for re-use. Materials other than carbon which have similar microwave properties may be used for the susceptor structure, such as silicon carbide and titanium diboride. A susceptor structure may consist of one material or several materials may be used.

Articles having different dimensions were sintered using the sintering structure and sintering container described above. Alumina disks prepared as described above having dimensions of 6.1875 inches by 0.5 inch thick and a weight of 545 grams were sintered to a density of 93% of theoretical. After sintering, the dimensions were about 4.875 inches diameter and 0.437 inch high. A hexagonal tile of alumina obtained from Coors Ceramics Co. of Golden, CO (Coors AD-995) weighing 420 grams before sintering was sintered to 94% of theoretical density. Before sintering, the hexagonal tile was heated to about 800° C. and held at that temperature to remove a binder which it contained upon receipt from the manufacturer. The before sintering dimensions were 5.5 inches diameter and 0.562 inch thick. After sintering, the dimensions were about 4.625 inches diameter and 0.5 inch thick. A 4.75 inch square tile of alumina (Coors AD-90) weighing 525 grams and having a thickness of 0.625 inch was sintered after removal of the binder as described above. After sintering dimensions were about 4.0 inches square and 0.5 inch thick.

A 0.375 inch thick by 2.5 inch square tile of AKP-50 alumina prepared as previously described weighing 75 grams was sintered using a sintering structure consisting of an upper susceptor of carbon (as described above) which was 3.25 inches square by 0.125 inch thick and a lower susceptor having the same dimensions. The tile rested on the lower susceptor and the upper susceptor rested on the tile. Susceptor side panels were not used in this embodiment of the invention. The sintering container was of alumina insulating material (as described above) and had a planform of 5.0 inches square. The base, top cover, and sidewalls were 1.5 inches thick. The clear height of the inside of the sintering container was 2.5 inches. After sintering dimensions were 2.0 inches square and 0.312 inch thick.

The term diameter is used herein, in addition to its dictionary meaning in regard to a circle, to refer to the major dimension of a non-circular article. The major dimension is the longest line which can be drawn between points on the perimeter of the article. For example, the diameter of a square divides the square into two right triangles of equal area. A plate-shaped article has a diameter which is at least four times larger than its thickness or height. Its planform may be of any common geometrical shape or its perimeter may be irregular. The opposing external faces of a plate-shaped article need not be flat or parallel to one another and may be irregular in contour. In such a case, it may be necessary to place shims between an article and base susceptor and upper susceptor. Though experimentation was done using alumina articles, it is expected that this invention may be used in connection with articles having similar microwave heating properties, such as of magnesia, silica, yttria, zirconia, alumina, and mixtures thereof. The invention is useful for sintering articles having a diameter of from about 2.0 inches to 3.0 feet. The thickness of a base susceptor will range from about 0.062 inch to about 2.0 inches and its diameter will be from about the diameter of the article before sintering to about 2.0 inches larger than the diameter of the article before sintering. The thickness of an upper susceptor will be from about 100% to about 250% of the thickness of the base susceptor and its diameter will be about the same as that of the base susceptor. Susceptor side panels may be omitted from the susceptor structure or the susceptor structure may comprise vertical portions which partially or completely enclose the perimeter of the base and upper susceptors. A sintering container will have an inside diameter from about 0.25 inch to about 5 inches greater than the diameter of the base susceptor. The clear vertical distance in a sintering container above a sintering structure will be from about 1.0 inch to about 4.0 inches. A sintering structure will be generally centered within a sintering container and an article within a sintering structure will be generally centered on the structure. It should be noted that the inventive apparatus is not limited to sintering structures and sintering containers assembled of separate components in the manner of the experimental containers, but that, for example, a structure or container may consist of only two separate pieces. The planform of a structure or container may be any common geometric shape or may be irregular. The sidewalls or susceptor side panels may be circular or irregular form (in plan view).

Development of the invention required a substantial amount of experimentation. Sintering articles using only alumina insulation in various configurations yielded poor results. Methods for creating a uniform field within a cavity, such as use of a stirring fan or rotating table have resulted in only limited success. Using microwaves of wave lengths shorter than 2.45 GHz does not work. It was necessary to develop apparatus which would result in an article being surrounded by a uniform microwave field while contained in a non-uniform cavity. The sintering structure creates an artificial microwave field surrounding an article and results in even heat distribution and control of the heating cycle.

What is claimed is:

1. Apparatus for microwave sintering of a plate-shaped article, where said article has a diameter to height ratio of 4 or greater, where said article has a diameter of from about 2.0 inches to about 3.0 feet, and where said article consists of one of the substances in a group consisting of alumina, magnesia, silica, yttria, zirconia, and mixtures of alumina, magnesia, silica, yttria, and zirconia, said apparatus comprising:

a. a susceptor structure consisting of one or more of the substances in a group consisting of carbon, silicon carbide, and titanium diboride, where said structure is comprised of:

(1) a plate-shaped base susceptor upon which said article rests and which has a thickness of from about 0.062 inch to about 2.0 inches and a diameter of from about the article diameter before sintering to about 2.0 inches greater than the article diameter before sintering;

(2) a plate-shaped upper susceptor which rests upon said article and which has a thickness of from about 100% to about 250% of the thickness of said base susceptor and a diameter which is approximately equal to that of the base susceptor; and b. a sintering container of insulating material which contains said susceptor structure, where said container has a base, sidewalls, and a top cover, where the inside diameter of the container is from about 0.250 inch to about 5.0 inches greater than the diameter of the base susceptor, and where the clear vertical distance between said upper susceptor and the sintering container is from about 1.0 inch to about 4.0 inches.

2. The apparatus of claim 1 where said susceptor structure further comprises susceptor side panels disposed about the perimeter of said base susceptor and said upper susceptor.

3. The apparatus of claim 1 further comprising a layer of alumina particles which rests upon the base of said sintering chamber and upon which rests said base susceptor.

4. A method for microwave sintering of a plate-shaped article, where said article has a diameter to height ratio of 4 or greater, where said article has a diameter of from about 2.0 inches to about 3.0 feet, and where said article consists of one of the substances in a group consisting of alumina, magnesia, silica, yttria, zirconia, and mixtures of alumina, magnesia, silica, yttria, and zirconia, said method comprising:

a. placing said article within apparatus comprised of:

(1) a susceptor structure consisting of one or more of the substances in a group consisting of carbon, silicon carbide, and titanium diboride, where said structure is comprised of:

(a) a plate-shaped base susceptor upon which said article rests and which has a thickness of from about 0.062 inch to about 2.0 inches and a diameter of from about the article diameter before sintering to about 2.0 inches greater than the article diameter before sintering;

(b) a plate-shaped upper susceptor which rests upon said article and which has a thickness of from about 100% to about 250% of the thickness of said base susceptor and a diameter which is approximately equal to that of the base susceptor; and (2) a sintering container of insulating material which contains said susceptor structure, where said container has a base, sidewalls, and a top cover, where the inside diameter of the container is from about 0.250 inch to about 5.0 inches greater than the diameter of the base susceptor, and where the clear vertical distance between said upper susceptor and the sintering container is from about 1.0 inch to about 4.0 inches;

b. heating the apparatus to a hold temperature within a hold temperature range by subjecting the apparatus to microwave radiation, where the rate of heating is no more than about 48° C. per minute, where said hold temperature range is from about 1400° to about 1700° C., and where said hold temperature is the surface temperature of said alumina article;

c. maintaining the article at a temperature within the hold temperature range for from about 5 to about 60 minutes by means of microwave radiation; and d. cooling the article to a temperature below about 1350° C. at a maximum rate of no more than 30° C. per minute, where said cooling rate is maintained below said maximum rate by subjecting the apparatus to microwave radiation.

5. The method of claim 4 where said microwave radiation has a frequency of 2.45 Ghz.

6. The method of claim 4 where said susceptor structure further comprises susceptor side panels disposed about the perimeter of said base susceptor and said upper susceptor.

* * * * *